US006362157B1

(12) United States Patent
Blochwitz et al.

(10) Patent No.: US 6,362,157 B1
(45) Date of Patent: Mar. 26, 2002

(54) METHOD FOR PRODUCING TENSIDE GRANULATES WITH A HIGHER BULK DENSITY

(75) Inventors: Olaf Blochwitz, Genthin; Georg Assmann, Juechen; Andreas Syldath; Ditmar Kischkel, both of Monheim; Karl-Heinz Schmid, Mettmann, all of (DE)

(73) Assignee: Cognis Deutschland GmbH, Duesseldorf (DE)

( * ) Notice: Subject to any disclaimer, the term of this patent is extended or adjusted under 35 U.S.C. 154(b) by 0 days.

(21) Appl. No.: 09/554,390

(22) PCT Filed: Nov. 5, 1998

(86) PCT No.: PCT/EP98/07060

§ 371 Date: Aug. 11, 2000

§ 102(e) Date: Aug. 11, 2000

(87) PCT Pub. No.: WO99/25805

PCT Pub. Date: May 27, 1999

(30) Foreign Application Priority Data

Nov. 14, 1997 (DE) ..... 197 50 424

(51) Int. Cl.[7] ..... C11D 11/00
(52) U.S. Cl. ..... 510/444; 23/313 FB
(58) Field of Search ..... 510/444, 313 FB

(56) References Cited

U.S. PATENT DOCUMENTS

| | | | | | |
|---|---|---|---|---|---|
| 3,650,037 | A | * | 3/1972 | Oetiker | 34/10 |
| 3,702,595 | A | * | 11/1972 | Muirhead et al. | 110/8 R |
| 4,552,681 | A | | 11/1985 | Koch et al. | |
| 4,648,969 | A | * | 3/1987 | Swanson | 210/237 |
| 4,946,653 | A | * | 8/1990 | Stopp et al. | 422/140 |
| 5,040,310 | A | * | 8/1991 | Huttlin | 34/57 A |
| 5,516,447 | A | * | 5/1996 | Bauer et al. | 23/313 FB |
| 5,672,781 | A | | 9/1997 | Koehler et al. | |
| 5,695,701 | A | * | 12/1997 | Funder et al. | 264/117 |
| 5,776,557 | A | * | 6/1998 | Luy et al. | 422/139 |
| 5,867,921 | A | * | 2/1999 | Maruyama et al. | 34/578 |
| 5,891,401 | A | * | 4/1999 | D'Acierno et al. | 422/143 |
| 5,917,097 | A | | 6/1999 | Koehler et al. | |
| 5,945,032 | A | * | 8/1999 | Breitenbach et al. | 252/186.29 |
| 6,030,937 | A | | 2/2000 | Kruse et al. | |

FOREIGN PATENT DOCUMENTS

| | | |
|---|---|---|
| DE | 41 27 323 | 2/1993 |
| DE | 43 35 781 | 4/1995 |
| DE | 44 25 180 | 1/1996 |
| DE | 195 24 464 | 1/1997 |
| EP | 1212939 | * 11/1970 |
| EP | 0 603 207 | 6/1994 |
| GB | 2 003 913 | 3/1979 |
| GB | 2 005 715 | 4/1979 |

* cited by examiner

*Primary Examiner*—Lorna M. Douyon
(74) *Attorney, Agent, or Firm*—John E. Drach; Steven J. Trzaska

(57) ABSTRACT

A process for making detergent granules having a bulk density above 500 g/l involving: (a) providing a fluidized bed; (b) providing an apertured inflow base located below the fluidized bed for introducing fluidization gas into the fluidized bed; (c) providing a grid interposed between the fluidized bed and the apertured inflow base, the grid having a mesh size of less than 600 $\mu$m; (d) providing a surfactant preparation in liquid to paste form; and (e) introducing the surfactant preparation into the fluidized bed to form the detergent granules.

13 Claims, 2 Drawing Sheets

METHOD FOR PRODUCING TENSIDE GRANULATES WITH A HIGHER BULK DENSITY

BACKGROUND OF THE INVENTION

The invention relates to a process for the preparation of washing- and cleaning-active surfactant-containing granules with a bulk density above 500 g/l from a surfactant preparation form which has a non-surface-active liquid component, in particular water, and which, at atmospheric pressure and temperatures between 20 and 80° C., is in liquid to paste form, by granulation and simultaneous drying in a fluidized bed above an inflow base provided with openings for the fluidization gas, in particular fluidization air, where the term drying means the partial or complete removal of the non-surface-active liquid component.

Such a process is known from European Patent Specification 0 603 207 B1 from the Applicant. The inflow base and the size and shape of its openings can vary, as has already been shown in detail in said patent specification.

In this known process, it is the case time and again, in particular when operation is interrupted, that granules fall through the openings of the inflow base into the particularly hot area below the base, where they are thermally damaged and discolored, and some pass back through the openings of the inflow base into the fluidized bed, meaning that the final product comprises white granules with brown to black spots, making the product overall unsuitable for use. If the particles which have fallen down through the inflow base remain in this hot area, then after each time the plant has been out of service it is necessary to clean this inflow zone and also the base itself to which these particles adhere, and this is time-consuming.

The problems arise particularly during the preparation of granules with particularly high bulk densities above 500 g/l. Sometimes even during operation, these particularly heavy particles drop against the fluidizing air through the openings in the inflow base into the lower hot area, from which they are blown back into the fluidized bed by the fluidizing air following thermal decomposition and breakage.

A particularly weighty problem in the case of the preparation of granules with particularly high bulk densities according to the known process is the baking-on of the hot granules, which are tacky because of their surfactant content, on the inflow base and in the region of its openings, where they gradually narrow the free cross section until the aeration for the fluidization gas can no longer compensate for the pressure loss resulting in this manner. The unit must be switched off at this point in time at the latest and the inflow base must be freed from the partially thermally decomposed cakings, which is very time-consuming.

The object of the invention was therefore to improve the efficiency of the process of the type mentioned in the introduction. In particular, the aim is to considerably prolong the duration of uninterrupted operation of a corresponding unit. Moreover, the intention is to improve the quality of the resulting product such that the danger of black or brown spots ("specks") on the preferably white granules no longer occurs.

DETAILED DESCRIPTION OF THE INVENTION

Figure 1:
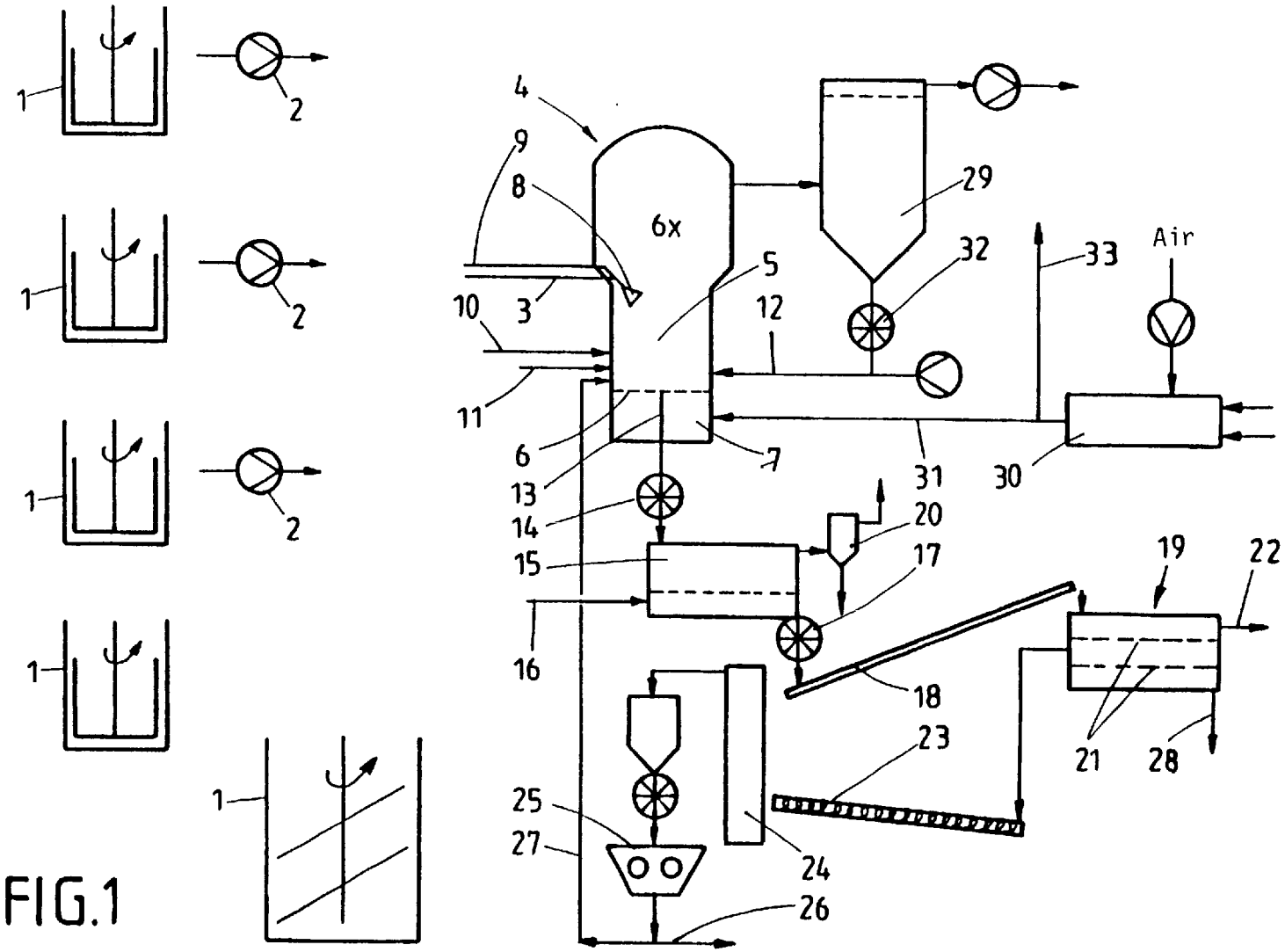
FIG. 1 is a schematic diagram of an embodiment of an apparatus used in the process of the invention.

This object is achieved according to the invention by covering the openings with a grid having a mesh size of less than 600 μm. The grid can be arranged within or above the openings. However, the grid preferably lies directly below the openings in the inflow base.

In one practical embodiment, a metal gauze with the corresponding mesh size can be sintered onto or attached in another way to the underside of an inflow base known per se. The metal gauze preferably consists of the same material as the inflow base, in particular of stainless steel.

The finely-meshed grid prevents the particles from falling through, particularly when the granulation unit is taken out of service unexpectedly or, however, in the case of heavy particles having bulk densities around 1000 g/l, even during operation.

The mesh size of said grid is preferably between 200 and 400 μm.

To remove the cakings, which arise during operation, on the upper side of the inflow base and on the grid filling up the openings, it is no longer necessary, or is necessary only at considerably longer intervals, to switch off the granulation device and subsequently clean it manually if, in a further advantageous embodiment of the invention, the upper side of the inflow base is cleaned during continuous operation by means of a slider, grater or the like. Such cleaning can be undertaken manually or automatically. The grater or scraper used for this purpose can consist of a thermally resistant plastic, e.g. polytetrafluoroethylene (PTFE) in order to ensure that damage to the inflow base is prevented.

In a similar manner, it is advantageous to clean the insides of readily accessible parts of the unit, in particular pipelines with a relatively large diameter, which tend to gradually become blocked as a result of adhering products or product constituents, using mechanical scrapers during continuous operation. An example of a product constituent of detergents and cleaners which has a tendency to adhere is fatty alcohol sulfates (FAS), which can hydrolyze at elevated temperatures.

It is further advantageous if the inflow base used has a pressure loss of at most 10 mbar and in particular at most 6 mbar.

When carrying out the granulation process, it is impossible to avoid the formation of oversize particles, i.e. granules having particle sizes above the desired range. It is known to grind the oversize particles, to add the resulting material particles, i.e. the granules within the desired particle size range, to the finished product stream, and to blow in the fine particles, i.e. the granules having particle sizes below the desired range, into the fluidized bed apparatus as nuclei.

However, problems arise during the grinding of particularly large oversize particles. These granules are generally not completely dried through and in their inside contain the still uncrystallized surfactant preparation form. This liquid to pasty and hot component bakes onto the mill rollers, meaning that the rollers have to be cleaned more often than usual.

To further improve the efficiency of the process mentioned in the introduction, in which the resulting granules are furthermore classified by screening according to the desired particle size range, it is therefore proposed that the undersize particles obtained during screening are returned to the fluidized bed, the oversize particles which are above the desired particle size but below a predetermined size are ground and likewise returned to the fluidized bed, and the oversize particles which are above the predetermined size are collected, cooled and only then ground and returned to the fluidized bed.

Said predetermined particle size is preferably about 10 mm. The desired particle size range is preferably 0.4 to 1.6 mm.

In the process according to the invention, it is favorable for the surfactant preparation form used to have a surfactant concentration of from 35 to 95% by weight. Particularly suitable compositions of the preparation form are given in EP 0 603 207 B1, to which reference is expressly made to supplement the disclosure.

The aqueous surfactant preparation form used has a relatively high viscosity of from 3000 to 20,000 mPas. This viscosity requires two-nozzle atomization.

When spraying the surfactant preparation form into the fluidized bed, a particularly fine distribution of the droplets is desired. The reasons for this lie in the need to produce a sufficient amount of fine particles which serve as nucleating material, alongside the granules in the desired particle size range. Furthermore, the proportion of oversize particles, i.e. of granules having particle sizes above the desired range, should be kept as small as possible. Fine dispersion of the droplets has the further advantage of a large surface area of the droplet or particle relative to the volume, meaning that it dries not only rapidly, but also completely, and no gelatinous tacky area remains on the inside which can lead to problems during storage and during use of the finished product.

For this reason it is proposed to spray the surfactant preparation form into the fluidized bed by means of at least one nozzle which has at least one additional nozzle channel for compressed air, in particular swirled air, to finely nebulize the surfactant preparation form. Preferably, the nozzle channel for the compressed air is on the outside, and the channel for the surfactant preparation form is on the inside.

The lower the liquid throughput through the nozzle, the higher the specific air consumption and the finer the drop dispersion. Too fine a drop dispersion is, however, a disadvantage since the droplets dry off virtually completely before they reach the granules present in the fluidized bed, meaning that the oversized content of nuclei which forms as a result is blown rapidly into the filter of the fluidized bed apparatus. Furthermore, in the case of droplets which have already partially solidified upon impact with the granules already present, undesired relatively light-weight agglomerates, i.e. a product with too low a bulk density, are obtained. By using suitable nozzles and adjusting a suitable air consumption and liquid throughput, a product with a relatively high bulk density can be prepared, a sufficient amount of new nuclei being produced at the same time. It has proven particularly advantageous to use a nozzle with an air consumption of from 0.5 to 1.3 kg of air/kg of liquid at a liquid throughput of from 150 to 850 kg/h.

In principle, the nozzles can be attached to the inside of the fluidized bed apparatus in various ways. For example it is known to attach the nozzles to holders on the inside of the fluidized bed apparatus. However, product constituents are deposited in a disadvantageous manner on the holders and on the supply pipes for the nozzles which in this case necessarily pass on the inside of the fluidized bed apparatus, meaning that cleaning is necessary from time to time. A further disadvantage of this arrangement is a possible interference of the fluidized bed by the holders and supply lines. This arrangement of the nozzles with their supply lines has nevertheless hitherto been chosen in order to ensure that uniform spraying of the fluidized bed from top to bottom is achieved.

The inventors have now surprising discovered that the required uniform spraying of the fluidized bed from top to bottom is also ensured when the nozzles are attached directly to the inside wall of the fluidized bed apparatus. In this case, they are arranged obliquely downward. In a further advantageous embodiment of the invention it is therefore proposed that the surfactant preparation form is sprayed in by means of nozzles arranged on the inside of the side wall of the fluidized bed apparatus, the feed lines for the nozzles running outside the fluidized bed apparatus. As well as the avoidance of cakings, the arrangement of the feed lines has the additional advantage that leaks in the feed lines can be recognized immediately by operating personnel and be dealt with from the outside in a simple manner. This arrangement of the nozzles further permits spraying in at varying heights.

In the fluidized bed granulation process of cited EP 0 603 207 B1, the addition of nuclei is necessary only at the start of the process. However, since during the production, granules outside of the desired particle size of the accepted product continually form, it is expedient for reasons of cost to introduce, in a further advantageous embodiment of the invention, 1 to 90% by weight, in particular 2 to 80% by weight, of nucleating material, based on the product output, into the fluidized bed during the continuous process.

This nucleating material is preferably prepared granules having too small a particle size or corresponding granules having too large a particle size, which have been ground and screened.

With regard to the fluidization air speeds used and preferred, reference is made to EP 0 603 207 B1. The preferred inlet temperature of the fluidization air is 80 to 230° C., and the preferred air exit temperature is 30 to 120° C.

Even in the known process, the product drawn off from the fluidized bed is cooled in a product cooler before it is packed. In contrast to the previous process, it is advantageous if, instead of ambient air being used for the cooling, incoming air which has already been cooled, in particular having a temperature of from 5 to 8° C., is used, meaning that in all cases, even on very hot summer days, a product temperature of less than 35° C. can be reliably maintained. The lower absolute moisture content of this precooled cooling air has advantages for the washing- and cleaning-active granules as well, since in this way further (residual) moisture is removed from the product, resulting in increased storage stability.

In or on the product cooler a filter is preferably incorporated, the filter dust of which is returned as nucleating material to the fluidized bed. In particular, the cooler operates of its own accord.

Also of advantage is the following filter system for the actual fluidized bed apparatus. In addition to an optional attached filter, a separate cyclone for separating particles is provided by an external filter system. The design of the filters depends on the respective material properties of the product to be granulated and on the amount of dust which forms.

The operation of the burner used can be direct or indirect. In the case of direct operation, the hot offgas from the burner comes directly into contact with the fluidized bed. In the case of indirect operation, which is preferred here, a heat exchanger is connected in series, in which the offgases heat the fluidization gas, e.g. air.

Figure 2:
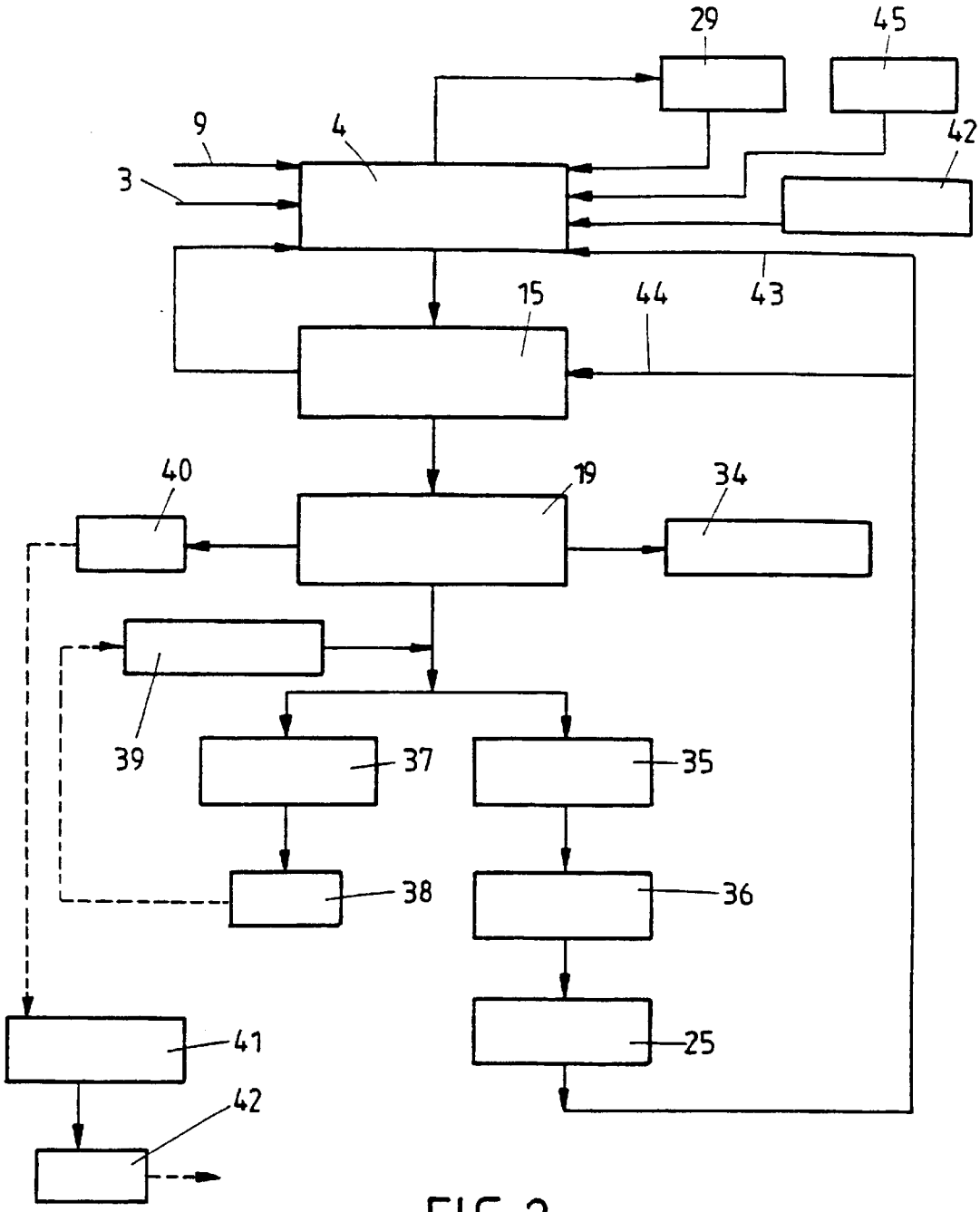
FIG. 2 is a product flow diagram.

Working examples of the process according to the invention which have been carried out in an apparatus as in FIG. 1 are described in more detail below. A product flowchart is shown in FIG. 2.

FIG. 1 shows an apparatus suitable for carrying out the process of the invention in a diagrammatic representation. The surfactant preparation form to be dried and to be granulated is passed from stirred storage containers 1 of varying size via metering pumps 2 and a line 3 to the fluidized bed granulation dryer 4. The storage containers 1 are connected to the lines 3 for the nozzles 8 such that various pumps 2 and nozzles 8 can be operated from the storage containers 1. In this way it is possible to mix the contents of various storage containers 1 in order to adjust the desired formulation. A further advantage is that it is possible, in cases of disorders, to switch from one nozzle 8 to another nozzle 8 without having to interrupt the operation of the granulation dryer 4.

The fluidized bed granulation dryer 4 consists essentially of two regions, namely an upper region having the fluidized bed zone 5 above an inflow base 6 provided with openings. The air required to maintain the fluidized bed, which is also used here for drying, flows from the lower, in particular hot area 7 upward through the openings in the inflow base 6.

In this example, the inflow base 6 consists of six circle-sector-shaped elements, leaving a central circular opening free for the downpipe 13. Alternatively, the base 6 can also be one piece. The inflow base is equipped with holes 2 mm in diameter and 10 mm apart (spacing). In operation, the stream of particles at the outside wall moves upward and from there to the central discharge area, where it is classified using the sifting air streaming upward. Granules above a certain particle size range fall down through the downpipe 13 to the cellular wheel feeder 14; the smaller and lighter particles again move in the proximity of the inflow base out toward the side wall of the fluidized bed granulation dryer 4.

In order to avoid relatively heavy granules prepared according to the invention from falling through the openings in the inflow base, a wire gauze having a mesh size of 0.3 mm is sintered below the base. The pressure loss of the entire base thus increases from 2 mbar to 6 mbar. With this arrangement of the inflow base 6, product fall-through was no longer observed, in contrast to a base without this wire gauze.

The pasty surfactant preparation form is passed via line 3 to six nozzles 8 where, using compressed air at about 3 bar, which is passed to the nozzles via line 3 and within the nozzles 8 is displaced into a swirling movement, it is dispersed into especially fine droplets. The nozzles 8 are attached to the inside of the side wall of the fluidized bed granulation dryer 4 and directed obliquely downward, it being possible to adjust the spray direction from outside. The droplets impact with the particles of the fluidized bed, are dried simultaneously and cause the particles of the fluidized bed to grow to give relatively large granules. The finely divided solids required for the process, the so-called nuclei, are fed to the fluidized. bed via lines 10, 11, 12. The nuclei originate from a variety of sources, as described below.

The granules whose particle size lies within or above the desired range are discharged via a downpipe 13 and a cellular wheel feeder 14 and passed to a cooler 15. For particle size classification, sifting air is allowed to pass into the downpipe 13 from below. For the sake of clarity, this detail is not shown in FIG. 1.

The still relatively hot granules are cooled using air which is at 5 to 8° C., which is fed in via line 16, leave the cooler 15 via a further cellular wheel feeder 17 and are passed by a conveyor belt 18 to a screening unit 19. The exit air from the cooler 15 is purified using a bag or pocket filter 20, the fines filtered off being returned to the fluidized bed as nucleating material.

The screening unit 19 consists of at least two screening planes 21. Oversize particles 22 having a size of more than 10 mm are collected, cooled and only later ground when these oversize particles have, on the inside too, also cooled sufficiently for these particles to be crystallized throughout. Coarse particles having a particle size below 10 mm, but above the desired particle size range are passed to a roller mill 25 via a screw 23 and a pneumatic steep conveyance section 24, and ground there. The gap width of the roller mill can be adjusted between 0.4 mm and 1.2 mm. The ground material can be passed either to the screening unit 19 (line 26) or back into the fluidized bed directly above the inflow base (line 27).

The acceptable particles obtained from the screening unit 19, i.e. the granules within the desired particle size range, are drawn off via line 28 and packaged.

To complete the fluidized bed granulation dryer 4, a filter unit 29 with a bag or pocket filter based on needled felt for the exit air, and a burner 30 for heating the fluidization air introduced via line 31 are provided. The burner is operated here using a so-called direct procedure. The unit is further equipped with an emergency chimney 33 behind the burner 30. Through this, the hot air from the burner (residual heat) can, in case of emergency, be released directly into the environment without additionally heating or fluidizing the organic constituents in the fluidized bed. In case of fire, the seat of the fire is rapidly extinguished by spraying in water from a specifically installed device. Since feed air is no longer sent through the fluidized bed, a fire cannot be fanned again, and the oxygen supply is simultaneously suppressed.

The exit air from the filter unit 29 can, following gas scrubbing, be reused as feed air for the burner 30 or the corresponding heat exchanger. In this way, a circulating air operation without emissions can be achieved.

The fines produced in the filter unit 29 are reintroduced into the fluidized bed likewise as nucleating material via a cellular wheel feeder 32 and line 12.

In the case of the granulation and drying of tacky products, the use of emptying valves is advantageous. The term emptying valves means valves for powders or granules with an option for automatic emptying. The use of such emptying valves is favorable in the area between the fluidized bed and the cellular wheel feeder 14, upstream of the cellular wheel feeder 32 of the main filter 29, and between the cooler 15 and the downstream cellular wheel feeder 17. In the case of tacky products, this avoids sticking of the cellular wheel feeders.

FIG. 2 again shows in summary a working example according to the invention of the process with reference to a product flow diagram. The reference numerals used here have the same meanings as in FIG. 1. The continuous lines show a continuous implementation of the corresponding process steps, and the dashed lines show a discontinuous implementation of the corresponding process steps.

The product prepared in the fluidized bed granulation dryer 4 is cooled down in the fluidized bed cooler 15 before being passed to a wobble screening machine 19. The accepted particles pass to the containerizing operation 34; the oversize particles are passed to a roller mill 25 via a storage container 35 and a dosage meter 36. Alternatively, the oversize particles can also be collected in a further storage container 37 and poured into big bags 38 and stored. The big bags can later be emptied in a metered manner (reference numeral 39) and passed to the roller mill 25. The particularly large oversize particles are likewise stored in big bags 40 and later passed to said roller mill 25 or another roller mill 41, the ground product in turn being poured into big bags 42 for subsequent use.

The ground product obtained from the roller mill 25 is passed, depending on the particle size, either to the fluidized bed granulation dryer 4 as nucleating material (line 43) or to the fluidized bed cooler 15 (line 44).

Nucleating material is also introduced into the fluidized bed granulation dryer 4 from other sources, namely fines from the offgas filter 29, from a silo 45 and from the big bags 42.

The table below gives parameters for two process examples according to the invention. The sulfates used were sodium salts. The term "fatty alcohol sulfate" means here sulfates prepared from a fatty alcohol mixture having the following proportions:

| | |
|---|---|
| $C_{12}$-fatty alcohol | 13% by weight |
| $C_{14}$-fatty alcohol | 6.5% by weight |
| $C_{16}$-fatty alcohol | 26% by weight |
| $C_{18}$-fatty alcohol | 53% by weight |

the remainder to 100% by weight is made up of other fatty alcohols.

| Parameter | Fatty alcohol sulfate | Lauryl alcohol sulfate |
|---|---|---|
| Paste temperature | 70° C. | 40° C. |
| Paste viscosity | 10,000 mPas | 3,000 mPas |
| Mesh size of the grid | 300 μm | 300 μm |
| Pressure loss of the inflow base | 6 mbar | 6 mbar |
| Screen cut | <1.6 mm | <1.25 mm |
| Surfactant concentration of the granules | 90% | 47% |
| Air consumption | 0.7 kg of air/kg of liquid | 0.7 kg of air/kg of liquid |
| Nozzle throughput of paste | 650 kg/h | 650 kg/h |
| Inlet temperature of the swirled air | 230° C. | 210° C. |
| Air exit temperature | 90° C. | 60° C. |
| Bulk density | 600 g/l | 700 g/l |

What is claimed is:

1. A process for making detergent granules having a bulk density above 500 g/l comprising:

(a) providing a fluidized bed;

(b) providing an apertured inflow base located below the fluidized bed for introducing fluidization gas into the fluidized bed;

(c) providing a grid interposed between the fluidized bed and the apertured inflow base, the grid having a mesh size of less than 600 μm;

(d) providing from 35 to 95% by weight of a surfactant preparation in liquid to paste form; and (e) introducing the surfactant preparation into the fluidized bed to form the detergent granules.

2. The process of claim 1 wherein the grid has a mesh size of from 200 to 400 μm.

3. The process of claim 1 wherein the inflow base has a pressure loss of at most 10 mbar.

4. The process of claim 1 wherein the surfactant preparation is introduced into the fluidized bed by way of at least one spray nozzle connected to a source of compressed air.

5. The process of claim 4 wherein the compressed air has an air consumption of from 0.5 to 1.3 kg of air/kg of liquid at a liquid throughput of from 150 to 850 kg/h.

6. The process of claim 4 wherein the spray nozzle is located on an inner side wall of the fluidized bed.

7. The process of claim 4 wherein feed lines for the spray nozzle are located outside of the fluidized bed.

8. The process of claim 6 wherein the spray nozzle is arranged in an obliquely downward direction.

9. The process of claim 1 further comprising screening the detergent granules according to particle size in order to obtain granules of predetermined particle size, undersized granules having a particle size smaller than the predetermined particle size, and oversized granules having a particle size greater than the predetermined particle size.

10. The process of claim 9 wherein the undersized granules are returned back into the fluidized bed.

11. The process of claim 9 wherein the oversized granules are first ground, and then returned back into the fluidized bed.

12. The process of claim 9 wherein the predetermined particle size is about 10 mm.

13. The process of claim 1 wherein the surfactant preparation has a viscosity of from 3,000 to 20,000 mPas.

* * * * *